US010107288B2

(12) United States Patent
Lin et al.

(10) Patent No.: US 10,107,288 B2
(45) Date of Patent: Oct. 23, 2018

(54) HOUSING FOR SCROLL COMPRESSOR AND SCROLL COMPRESSOR

(71) Applicant: Danfoss (Tianjin) Ltd., Tianjin (CN)

(72) Inventors: Ma Lin, Tianjin (CN); Sun Zili, Tianjin (CN); Jiang Wei, Tianjin (CN); Yao Wenhu, Tianjin (CN); Wang Feifei, Tianjin (CN); Chen Yu, Tianjin (CN); Zhang Kailai, Tianjin (CN); Zhang Jiunan, Tianjin (CN)

(73) Assignee: Danfoss (Tianjin) Ltd., Tianjin (CN)

( * ) Notice: Subject to any disclaimer, the term of this patent is extended or adjusted under 35 U.S.C. 154(b) by 388 days.

(21) Appl. No.: 14/734,061

(22) Filed: Jun. 9, 2015

(65) Prior Publication Data

US 2015/0354566 A1 Dec. 10, 2015

(30) Foreign Application Priority Data

Jun. 10, 2014 (CN) ..... 2014 1 0254876

(51) Int. Cl.
*F04C 18/02* (2006.01)
*F04C 29/00* (2006.01)
(Continued)

(52) U.S. Cl.
CPC ..... *F04C 18/0215* (2013.01); *F04C 23/008* (2013.01); *F04C 29/0085* (2013.01);
(Continued)

(58) Field of Classification Search
CPC ..... F04C 18/0215; F04C 23/008; F04C 29/0085; F04C 29/02; F04C 29/028; F04C 29/045
See application file for complete search history.

(56) References Cited

U.S. PATENT DOCUMENTS 4,932,845 A 6/1990 Kikuchi et al.
6,289,776 B1 * 9/2001 Altstadt ..... B23B 31/12 279/110

(Continued)

FOREIGN PATENT DOCUMENTS

CN 1181128 A 5/1998
CN 1629485 A 6/2005

(Continued)

*Primary Examiner* — Mark Laurenzi
*Assistant Examiner* — Wesley Harris
(74) *Attorney, Agent, or Firm* — McCormick, Paulding & Huber LLP

(57) ABSTRACT

A housing for a scroll compressor and a scroll compressor are provided. The housing includes: a cannular central part; a center hole disposed at the cannular central part; a plurality of arms substantially extending radially from the cannular central part, the plurality of arms being used to be connected with a fixed scroll of the scroll compressor; and a thrust bearing surface disposed on a first side of the cannular central part in an axial direction, the thrust bearing surface being used to support an orbiting scroll. The orbiting scroll is supported with low friction, the motor supporting shell tube and the fixed scroll are connected with better alignment, and materials and machining costs are saved. In addition, the housing can provide better support for a scroll set, thereby achieving better performance.

16 Claims, 3 Drawing Sheets

(51) Int. Cl.

| | |
|---|---|
| ***F04C 23/00*** | (2006.01) |
| ***F04C 29/02*** | (2006.01) |
| ***F04C 29/04*** | (2006.01) |

(52) U.S. Cl.

CPC ..... *F04C 29/02* (2013.01); *F04C 29/028* (2013.01); *F04C 29/045* (2013.01)

(56) References Cited

U.S. PATENT DOCUMENTS

| | | | | |
|---|---|---|---|---|
| 7,316,550 | B2 | 1/2008 | Kim et al. | |
| 2003/0063986 | A1* | 4/2003 | Ginies ..... | F04C 23/008 417/366 |
| 2006/0093506 | A1 | 5/2006 | Kim | |
| 2006/0222546 | A1 | 10/2006 | Lee et al. | |
| 2013/0251567 | A1 | 9/2013 | Wang et al. | |

FOREIGN PATENT DOCUMENTS

| | | | |
|---|---|---|---|
| CN | 1637297 | A | 7/2005 |
| CN | 101749235 | A | 6/2010 |
| CN | 103807170 | A | 5/2014 |
| EP | 0819220 | B1 | 12/1999 |
| EP | 2 131 040 | A2 | 12/2009 |
| JP | 2006-283751 | A | 10/2006 |
| KR | 20110006181 | A | 1/2011 |
| KR | 10-1275181 | B1 | 6/2013 |
| KR | 10-1553953 | B1 | 9/2015 |
| WO | 2012096444 | A1 | 7/2012 |

* cited by examiner

HOUSING FOR SCROLL COMPRESSOR AND SCROLL COMPRESSOR

CROSS REFERENCE TO RELATED APPLICATIONS

Applicant hereby claims foreign priority benefits under U.S.C. § 119 from Chinese Patent Application Serial No. CN201410254876.9 filed on Jun. 10, 2014, the contents of which are incorporated by reference herein.

FIELD OF THE INVENTION

The present invention relates to the field of refrigeration and air-conditioning technologies, and more particularly, to a housing for a scroll compressor and a scroll compressor.

BACKGROUND

A conventional housing of a scroll compressor requires relatively more materials and requires higher machining costs. It is difficult for the conventional housing to achieve high efficiency and high reliability due to a large thrust bearing surface of the conventional housing.

SUMMARY

Embodiments of the present invention provide a housing for a scroll compressor and a scroll compressor, thereby an orbiting scroll can be supported with low friction, a motor supporting shell tube and a fixed scroll can be connected with better alignment and materials and machining costs can be saved.

According to an aspect of the present invention, a housing for a scroll compressor includes:

a cannular central part;

a center hole disposed at the cannular central part;

a plurality of arms substantially extending radially from the cannular central part, wherein the plurality of arms are configured to be connected with a fixed scroll of the scroll compressor; and a thrust bearing surface disposed on a first side of the cannular central part in an axial direction, wherein the thrust bearing surface is configured to support an orbiting scroll.

According to an aspect of the present invention, the housing for a scroll compressor further includes: a threaded hole disposed in each one of the plurality of arms, wherein the threaded hole extends along the axial direction, and is configured to connect the fixed scroll with the housing through screws.

According to an aspect of the present invention, the housing for a scroll compressor further includes: a channel disposed between adjacent arms in the plurality of arms, wherein the channel has a function of a gas passage.

According to an aspect of the present invention, the center hole has a larger-diameter section on the first side in the axial direction and a smaller-diameter section on a second side opposite to the first side in the axial direction; the larger-diameter section is applied as an oil cup, configured to accommodate lubricating oil for lubricating the thrust bearing surface.

According to an aspect of the present invention, the housing for a scroll compressor further includes: a corner part located between the center hole and the thrust bearing surface, wherein the corner part is non-circular, which promotes lubrication of the thrust bearing surface.

According to an aspect of the present invention, the thrust bearing surface is in a shape of a substantially circular ring.

According to an aspect of the present invention, a drive shaft of the scroll compressor is rotatably supported in the smaller-diameter section.

According to an aspect of the present invention, the housing for a scroll compressor further includes: an oil drainage hole substantially throughout the cannular central part in a radial direction and in communication with the large-diameter section.

According to an aspect of the present invention, the housing for a scroll compressor further includes: a projection disposed on each one of the plurality of arms on the second side opposite to the first side in the axial direction, wherein an outer surface of the projection in a radial direction fits with a motor supporting shell tube.

According to an aspect of the present invention, the housing for a scroll compressor further includes: a rib portion connected between the cannular central part and the projection.

According to an aspect of the present invention, the rib portion and the projection have respective end faces on the second side in the axial direction, and the end face of the rib portion is at a side in the axial direction, which is close to the first side, of the end face of the projection.

According to an aspect of the present invention, the housing for a scroll compressor further includes: a step disposed on a first side in an axial direction of each one of the plurality of arms, the step being used to fit with a corresponding section of the fixed scroll.

According to an aspect of the present invention, the housing for a scroll compressor further includes: a step disposed on a first side in an axial direction of each one of the plurality of arms, the step being used to fit a corresponding section of the fixed scroll, and the threaded hole being formed in the step.

According to an aspect of the present invention, a scroll compressor includes: a shell; a motor; the above-mentioned housing; an orbiting scroll connected with the drive shaft, wherein the orbiting scroll is supported on a thrust bearing surface of the housing; and a fixed scroll connected with a plurality of arms of the housing.

According to an aspect of the present invention, a projection disposed on each one of the plurality of arms on the second side opposite with the first side in the axial direction, wherein an outer surface of the projection in a radial direction fits with a motor supporting shell tube; and a rib portion connected between the cannular central part and the projection, and the scroll compressor further includes: a counterweight located below the rib portion of the housing and located in a closed space above the motor.

According to an aspect of the present invention, the scroll compressor further includes:

a suction inlet passing through the shell; and a motor supporting shell tube covering the motor and located in the shell;

wherein the suction inlet is configured to suck in gas, so that the gas enters a channel, which is disposed between adjacent arms of the plurality of arms of the housing, along a passage formed by a gap between the motor supporting shell tube and the shell, so as to enter a compression mechanism formed by the fixed scroll and the orbiting scroll.

According to an aspect of the present invention, the center hole has a larger-diameter section on the first side in the axial direction and a smaller-diameter section on a second side opposite with the first side in the axial direction;

wherein the larger-diameter section functions as an oil cup, configured to accommodate lubricating oil for lubricating the thrust bearing surface;

wherein the housing further comprises: an oil drainage hole substantially throughout the cannular central part in a radial direction and in communication with the large-diameter section, and the lubricating oil flows back to an oil sump of the scroll compressor along the oil drainage hole via the passage formed by the gap between the motor supporting shell tube and the shell.

According to the technical solution of the present invention, the orbiting scroll is supported with low friction, the motor supporting shell tube and the fixed scroll are connected with better alignment, and materials and mechanical machining costs are saved.

Moreover, by using the housing for a scroll compressor according to embodiments of the present invention, technical effects of high efficiency and high reliability of a scroll compressor can be achieved and materials and machining costs are saved.

In addition, the housing of the present invention can provide better support for a scroll group, thereby achieving better performance. The housing of the present invention has a small deformation and a better structure and therefore has greater stability and higher strength even in unfavorable conditions.

DETAILED DESCRIPTION

The present invention is further described below with reference to the accompanying drawings and specific embodiments.

Figure 1:
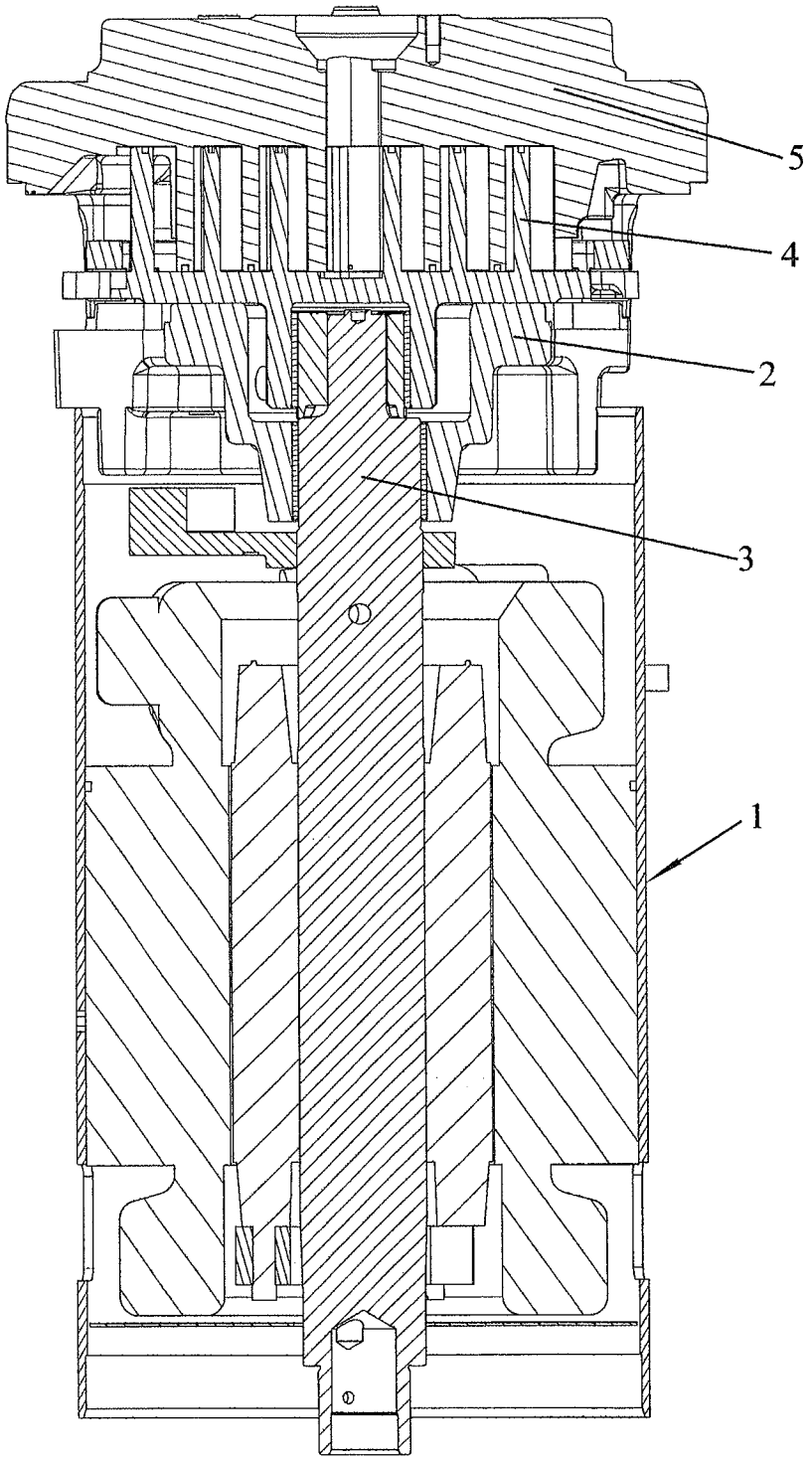
FIG. 1 is a schematic diagram of a scroll compressor according to an embodiment of the present invention, wherein a shell of the scroll compressor is removed.
Figure 6:
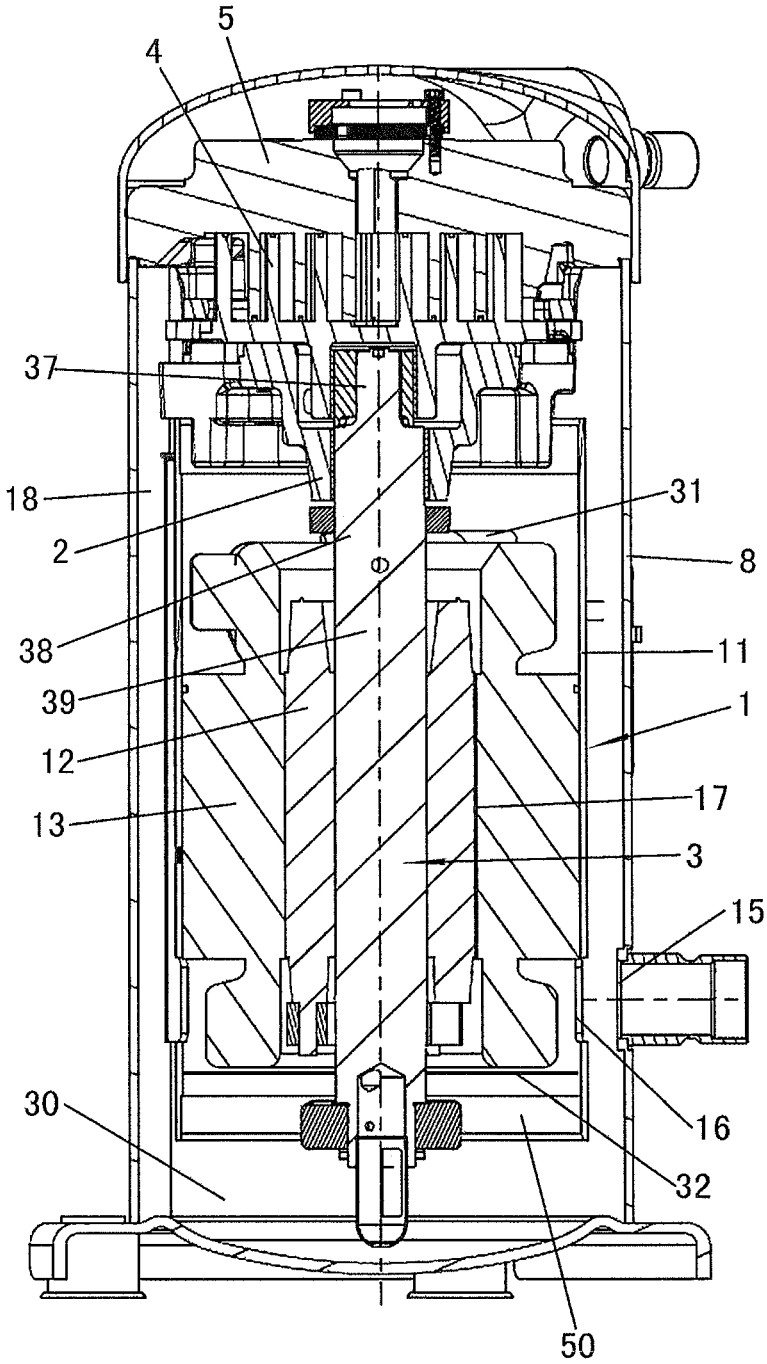
FIG. 6 is a schematic diagram of a scroll compressor according to an embodiment of the present invention.

As shown in FIG. 1 and FIG. 6, a scroll compressor according to an embodiment of the present invention includes: a shell 8; an orbiting scroll 4 disposed in the shell 8; a fixed scroll 5 disposed in the shell 8, and an oil sump 30 disposed at the bottom of the shell 8 and configured to accumulate lubricating oil. The orbiting scroll 4 and the fixed scroll 5 together form a compression component. The scroll compressor further includes: a housing 2 and a motor 1. The housing 2 is configured to support the fixed scroll 5, and has a gas passage throughout the housing 2 and leading to the compression component, for example, a gas passage axially throughout the housing 2 and leading to the compression component. The motor 1 is disposed below the housing 2, and includes a rotor 12, a stator 13, a drive shaft 3 passing through the rotor 12 and being in connection with the rotor 12, and a motor supporting shell tube 11. The drive shaft 3 is connected with the orbiting scroll 4, the motor supporting shell tube 11 is disposed in the shell 8, an upper end of the motor supporting shell tube 11 is connected with the housing 2, and the rotor 12 and the stator 13 are disposed in the motor supporting shell tube 11. The motor supporting shell tube 11 is connected with the stator 13, and is configured to keep the stator 13 and the rotor 12 and the drive shaft 3 in the shell 8. The motor supporting shell tube 11 may be cylindrical. The scroll compressor may further include a sealing part 32, configured to seal a lower end of the motor supporting shell tube 11. The fixed scroll 5 is connected with a plurality of arms 22 of the housing 2.

As shown in FIG. 6, the scroll compressor further includes: a first suction inlet 15, a second suction inlet 16, a first passage 18 and a second passage 17. The first suction inlet 15 is at a lower portion of the shell 8 and is throughout the lower portion. An air suction pipe may be disposed on the first suction inlet 15. The second suction inlet 16 is throughout a lower portion of the motor supporting shell tube 11. The second passage 17 is formed by a gap between the rotor 12 and the stator 13, and gas sucked from the first suction inlet 15 enters the second passage 17 via the second suction inlet 16 and enters the compression component along the second passage 17 through the gas passage formed in the housing 2. The orbiting scroll 4 is supported on a thrust bearing surface of the housing 2. The fixed scroll 5 is connected with the housing 2.

As shown in FIG. 6, the first passage 18 is formed by a gap between the shell 8 and the motor supporting shell tube 11, and the gas sucked from the first suction inlet 15 enters the compression component through the gas passage formed in the housing 2 via the first passage 18. Lubricating oil from the compression component returns to the oil sump 30 through the first passage 18. The lubricating oil can be transported to the compression component through a through hole in the drive shaft 3 of the motor 1, and returns to the oil sump 30 via the first passage 18.

The first suction inlet 15 is used to suck in gas, so that the gas enters a channel which is disposed between adjacent arms of the plurality of arms of the housing, along the first channel 18 formed by the gap between the motor supporting shell tube 11 and the shell 8, and then enters a compression mechanism formed by the fixed scroll and the orbiting scroll.

The lubricating oil flows back to the oil sump 30 of the compressor via an oil drainage hole along the first channel 18 formed by the gap between the motor supporting shell tube 11 and the shell 8.

By using the structure of the present invention, refrigerant flows are distributed properly and can cool the motor more effectively because a refrigerant enters the compression component through the first passage 18 and the second passage 17 and the lubricating oil returns to the oil sump 30 through the first passage 18.

As shown in FIG. 6, the scroll compressor further includes: a counterweight 31, wherein the counterweight 31 is connected with the drive shaft 3 of the motor 1, located between the housing 2 and the motor 1 in an axial direction, and located between the drive shaft 3 and a motor supporting shell tube in a radial direction. The counterweight 31 is rotatable in the motor supporting shell tube 11.

As shown in FIG. 6, the drive shaft 3 of the motor 1 may be a stepped shaft, and the drive shaft 3 may include a first section 37 located at an end portion of the drive shaft 3 and connected with the orbiting scroll 4, and a second section adjacent to the first section 37. The diameter of the first section is less than that of the second section. Alternatively, the drive shaft 3 of the motor 1 may be a stepped shaft and may include a first section 37 located at an end portion of the drive shaft 3 and connected with the orbiting scroll 4, a second section 38 adjacent to the first section 37, and a third section 39 adjacent to the second section 38 The diameter of the first section 37 is less than that of the second section 38, the diameter of the second section 38 is less than that of the third section 39, and the counterweight 31 is mounted on the second section 38 of the drive shaft 3. Due to the use of the stepped shaft, the counterweight can be assembled more easily, a bearing surface of the housing 2 would not be damaged during assembly, and assembly of related members is also much easier.

As shown in FIG. 6, the scroll compressor may further include: a support component 50, wherein the support component 50 is disposed in the motor supporting shell tube 11 and is used to support a lower end of the drive shaft 3 of the motor 1, and a peripheral portion of the support component 50 is connected with the motor supporting shell tube 11.

As shown in FIG. 2 to FIG. 5, the housing 2 includes: a cannular central part 21; a center hole 211 disposed at the cannular central part 21; a plurality of arms 22 substantially extending radially from the cannular central part 21, the plurality of arms 22 being used to be connected with a fixed scroll 5 of the scroll compressor; and a thrust bearing surface 23 on a first side of the cannular central part 21 in an axial direction, the thrust bearing surface 23 being used to support an orbiting scroll 4. The number of the arms 22 may be two, three, four or more. The cannular central part 21 may be a cylindrical central part.

Figure 2:
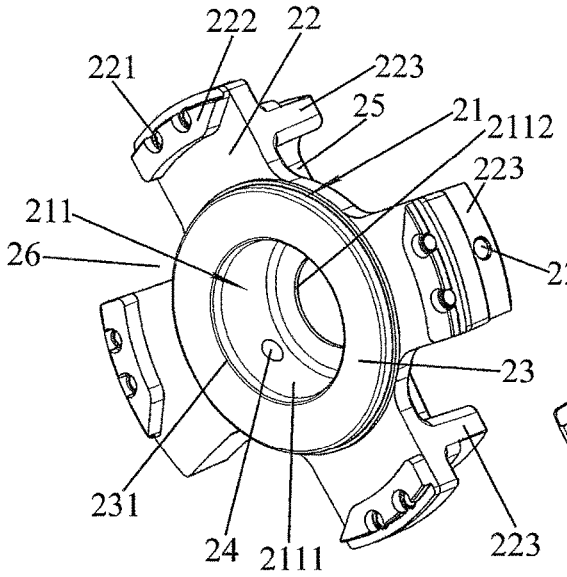
FIG. 2 to FIG. 5 are schematic diagrams of a housing for a scroll compressor according to an embodiment of the present invention.
Figure 5:
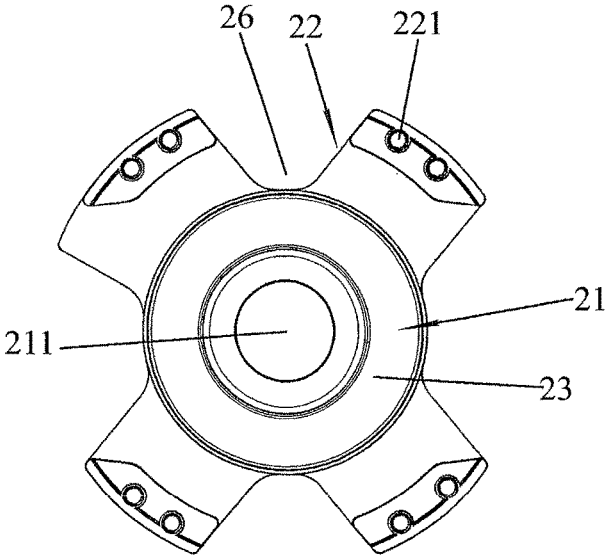

As shown in FIG. 2 and FIG. 5, the thrust bearing surface 23 may be in a shape of a substantially circular ring. Inside and outside diameters of the thrust bearing surface 23 are optimized, so that the thrust bearing surface 23 has high performance and high reliability. For example, the whole supporting surface is narrowed inwards along the radial direction compared with that of a traditional scroll compressor, and it is thus easier for the orbiting scroll to remain stable when the orbiting scroll orbits. In the illustrated embodiment, the number of the arms 22 is four. As shown in FIG. 2, the center hole 211 has a larger-diameter section 2111 on the first side in the axial direction and a smaller-diameter section 2112 on a second side opposite to the first side in the axial direction, the larger-diameter section 2111 is used as an oil cup, and lubricating oil for lubricating the thrust bearing surface 23 is accommodated in the oil cup. A drive shaft of the scroll compressor is rotatably supported in the smaller-diameter section 2112. The smaller-diameter section 2112 restricts the drive shaft of the scroll compressor in the radial direction.

As shown in FIG. 2 to FIG. 5, the housing 2 may further include: a threaded hole 221 disposed in each one of the plurality of arms 22. The threaded hole 221 extends along an axial direction of the arms, and is configured to connect the housing 2 with the fixed scroll 5 through screws. As shown in FIG. 2 to FIG. 5, the housing 2 may further include: a step 222 disposed on a first side in an axial direction of each one of the plurality of arms 22, the step 222 being used to fit with a corresponding section of the fixed scroll 5. The step 222 may be located at an edge of the arms 22 extending outwards along the radial direction. The threaded hole 221 may be disposed on the step 222. For example, the step 222 fits a key of the fixed scroll 5, so as to align the fixed scroll 5 in the radial direction, that is, align the center of the housing with the center of the fixed scroll.

As shown in FIG. 2 to FIG. 5, the housing 2 may further include: a channel 26 disposed between adjacent arms 22 in the plurality of arms 22, and the channel 26 may be used as a gas passage.

As shown in FIG. 1, a corner 231 between the center hole 211 and the thrust bearing surface 23 is a non-circular corner, to promote lubrication of the thrust bearing surface 23. In addition, the non-circular corner can improve reliability of the thrust bearing surface 23.

As shown in FIG. 2, the housing 2 may further include: an oil drainage hole 24 substantially throughout the cannular central part 21 in a radial direction and in communication with the large-diameter section 2111. The oil drainage hole 24 is in communication with the outside of the larger-diameter section 2111, to drain redundant lubricating oil and achieve a better lubricating effect.

Figure 3:
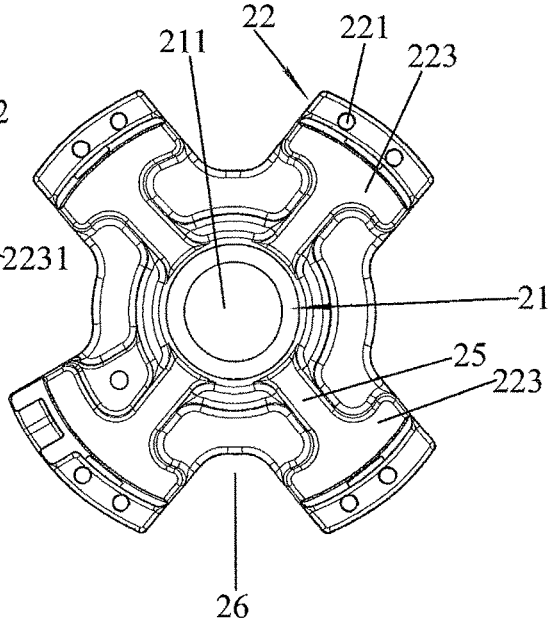
Figure 4:
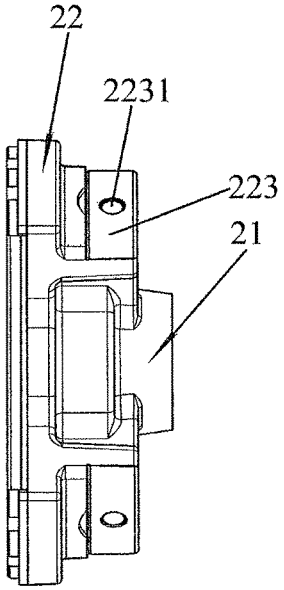

As shown in FIG. 2 to FIG. 4, the housing 2 may further include a projection 223 disposed on each one of the plurality of arms 22 on the second side opposite to the first side in the axial direction, wherein an outer surface of the projection 223 in a radial direction fits a motor supporting shell tube. As shown in FIG. 2 and FIG. 4, the projection 223 is provided with a threaded hole 2231, configured to secure the motor supporting shell tube through screws. The housing 2 may further include: a rib portion 25 connected between the cannular central part 21 and the projection 223. The rib portion 25 can improve strength and rigidity of the housing 2. As shown in FIG. 4, on the second side in the axial direction, the rib portion 25 and the projection 223 have respective end faces; in the axial direction, the end face of the rib portion 25 is on a side, which is close to the first side, of the end face of the projection 223. That is, compared with the projection 223, the rib portion 25 has a smaller height; therefore, a counterweight 31 may be disposed below the rib portion 25, the counterweight may have a hub portion, and is mounted on the drive shaft 3 through the hub portion; in addition, the counterweight may further have a fan-shaped section radially extending outwards from the hub portion, and an edge section at a radial outer edge of the fan-shaped section, thereby making the weight of the counterweight concentrated on the outermost side in the radial direction.

According to the technical solution of the present invention, the orbiting scroll is supported with low friction, the motor supporting shell tube and the fixed scroll are connected with better alignment, and materials and mechanical machining costs are saved.

Moreover, by using the housing for a scroll compressor according to the present invention, technical effects of high efficiency and high reliability of a scroll compressor can be achieved and materials and machining costs are saved.

In addition, the housing of the present invention can provide better support for a scroll group, thereby achieving better performance. The housing of the present invention has a small deformation and a better structure and therefore has greater stability and higher strength even in unfavorable conditions.

The foregoing provides only some embodiments of the present invention, and those skilled in the art will understand that changes may be made to these embodiments without departing from the principle of the general inventive concept, and the scope of the present invention is defined by the claims and equivalents thereof.

What is claimed is:

1. A housing for a scroll compressor, comprising:

a cannular central part;

a center hole disposed at the cannular central part;

a plurality of arms substantially extending radially from the cannular central part, wherein the plurality of arms are configured to be connected with a fixed scroll of the scroll compressor;

a thrust bearing surface disposed on a first side of the cannular central part in an axial direction, wherein the thrust bearing surface is configured to support an orbiting scroll; and a projection disposed on each one of the plurality of arms on a second side opposite to the first side in the axial direction, wherein an outer surface of the projection in a radial direction fits with a motor supporting shell tube.

2. The housing for a scroll compressor according to claim 1, further comprising: a threaded hole disposed in each one of the plurality of arms, wherein the threaded hole extends along the axial direction, and is configured to connect the fixed scroll with the housing through screws.

3. The housing for a scroll compressor according to claim 2, further comprising: a step disposed on a first side in an axial direction of each one of the plurality of arms, the step being used to fit a corresponding section of the fixed scroll, and the threaded hole being formed in the step.

4. The housing for a scroll compressor according to claim 1, further comprising: a channel disposed between adjacent arms in the plurality of arms, wherein the channel has a function of a gas passage.

5. The housing for a scroll compressor according to claim 1, wherein the center hole has a larger-diameter section on the first side in the axial direction and a smaller-diameter section on a second side opposite to the first side in the axial direction; the larger-diameter section is applied as an oil cup, configured to accommodate lubricating oil for lubricating the thrust bearing surface.

6. The housing for a scroll compressor according to claim 5, wherein a drive shaft of the scroll compressor is rotatably supported in the smaller-diameter section.

7. The housing for a scroll compressor according to claim 5, further comprising: an oil drainage hole substantially throughout the cannular central part in a radial direction and in communication with the larger-diameter section.

8. The housing for a scroll compressor according to claim 1, further comprising: a corner part located between the center hole and the thrust bearing surface, wherein the corner part is non-circular, which promotes lubrication of the thrust bearing surface.

9. The housing for a scroll compressor according to claim 1, wherein the thrust bearing surface is in a shape of a substantially circular ring.

10. The housing for a scroll compressor according to claim 1, further comprising: a rib portion connected between the cannular central part and the projection.

11. The housing for a scroll compressor according to claim 10, wherein the rib portion and the projection have respective end faces on the second side in the axial direction, and the end face of the rib portion is closer in the axial direction to the first side than the end face of the projection.

12. The housing for a scroll compressor according to claim 1, further comprising: a step disposed on a first side in an axial direction of each one of the plurality of arms, the step being used to fit with a corresponding section of the fixed scroll.

13. A scroll compressor, comprising:

a shell;

a motor;

a housing;

an orbiting scroll connected with the drive shaft, wherein the orbiting scroll is supported on a thrust bearing surface of the housing; and a fixed scroll connected with a plurality of arms of the housing;

wherein the housing comprises:

a cannular central part;

a center hole disposed at the cannular central part;

the plurality of arms substantially extending radially from the cannular central part, wherein the plurality of arms are configured to be connected with the fixed scroll of the scroll compressor; and the thrust bearing surface disposed on a first side of the cannular central part in an axial direction, wherein the thrust bearing surface is configured to support the orbiting scroll; and a projection disposed on each one of the plurality of arms on a second side opposite with the first side in the axial direction, wherein an outer surface of the projection in a radial direction fits with a motor supporting shell tube and the motor supporting shell tube covers the motor and is located in the shell.

14. The scroll compressor according to claim 13, wherein the housing further comprises: a rib portion connected between the cannular central part and the projection, and the scroll compressor further comprises: a counterweight located below the rib portion of the housing and located in a closed space above the motor.

15. The scroll compressor according to claim 14, further comprising:

a suction inlet passing through the shell; and wherein the suction inlet is configured to suck in gas, so that the gas enters a channel, which is disposed between adjacent arms of the plurality of arms of the housing, along a passage formed by a gap between the motor supporting shell tube and the shell, so as to enter a compression mechanism formed by the fixed scroll and the orbiting scroll.

16. The scroll compressor according to claim 15, wherein the center hole has a larger-diameter section on the first side in the axial direction and a smaller-diameter section on a second side opposite with the first side in the axial direction;

wherein the larger-diameter section functions as an oil cup, configured to accommodate lubricating oil for lubricating the thrust bearing surface;

wherein the housing further comprises: an oil drainage hole substantially throughout the cannular central part in a radial direction and in communication with the large-diameter section, and the lubricating oil flows back to an oil sump of the scroll compressor along the oil drainage hole via the passage formed by the gap between the motor supporting shell tube and the shell.

* * * * *